United States Patent [19]

Kowalsky

[11] 3,984,826

[45] *Oct. 5, 1976

[54] CONDITION DETECTOR, ESPECIALLY FOR DETECTING ATMOSPHERIC CONDITIONS

[76] Inventor: Stanley J. Kowalsky, 4 Stan St., Latrobe, Pa. 15650

[ * ] Notice: The portion of the term of this patent subsequent to July 22, 1992, has been disclaimed.

[22] Filed: Feb. 28, 1975

[21] Appl. No.: 554,133

[52] U.S. Cl. ..... 340/227 R; 340/237 R

[51] Int. Cl.[2] ..... G08B 17/10

[58] Field of Search ..... 340/227 R, 420, 227.1, 340/228 R, 228.1, 228.2, 237 R, 237 S

[56] References Cited

UNITED STATES PATENTS

| | | | |
|---|---|---|---|
| 2,699,538 | 1/1955 | Nickel | 340/237 S |
| 3,896,422 | 7/1975 | Kowalsky | 340/420 |

*Primary Examiner*—Glen R. Swann, III

*Attorney, Agent, or Firm*—Melvin A. Crosby

[57] ABSTRACT

In a condition detector for detecting conditions in more than a single region, a pilot flame is established by a controlled supply of fuel to a burner at the bottom of a vertically elongate chimney. The chimney is closed at the bottom and combustion air for the flame enters the top of the chimney and flows downwardly therein. The flame is extinguished, or diminished, when combustion products or gases other than oxygen enter the upper end of the chimney and reduce the supply of oxygen to the flame. A flame detecting switch device adjacent the pilot flame burner, is actuated in response to extinguishing, or diminishing of the flame and may be connected to cause a signal, such as an alarm, to be actuated. The detector is mounted in an enclosure and ducts lead from the enclosure to regions which are to be monitored by the detector whereby the gases from the regions influence the detector.

12 Claims, 4 Drawing Figures

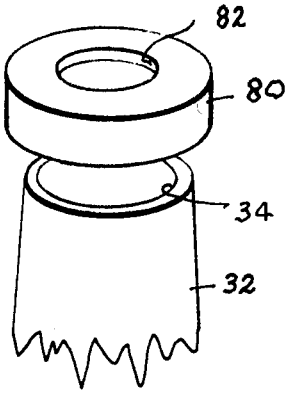
FIG. 2
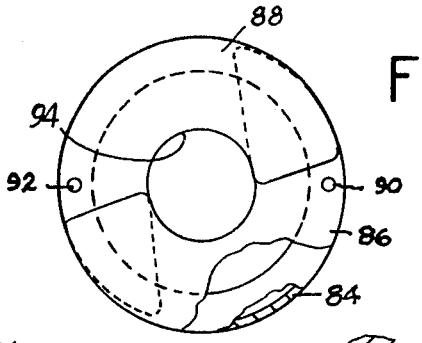
FIG. 3
FIG. 1
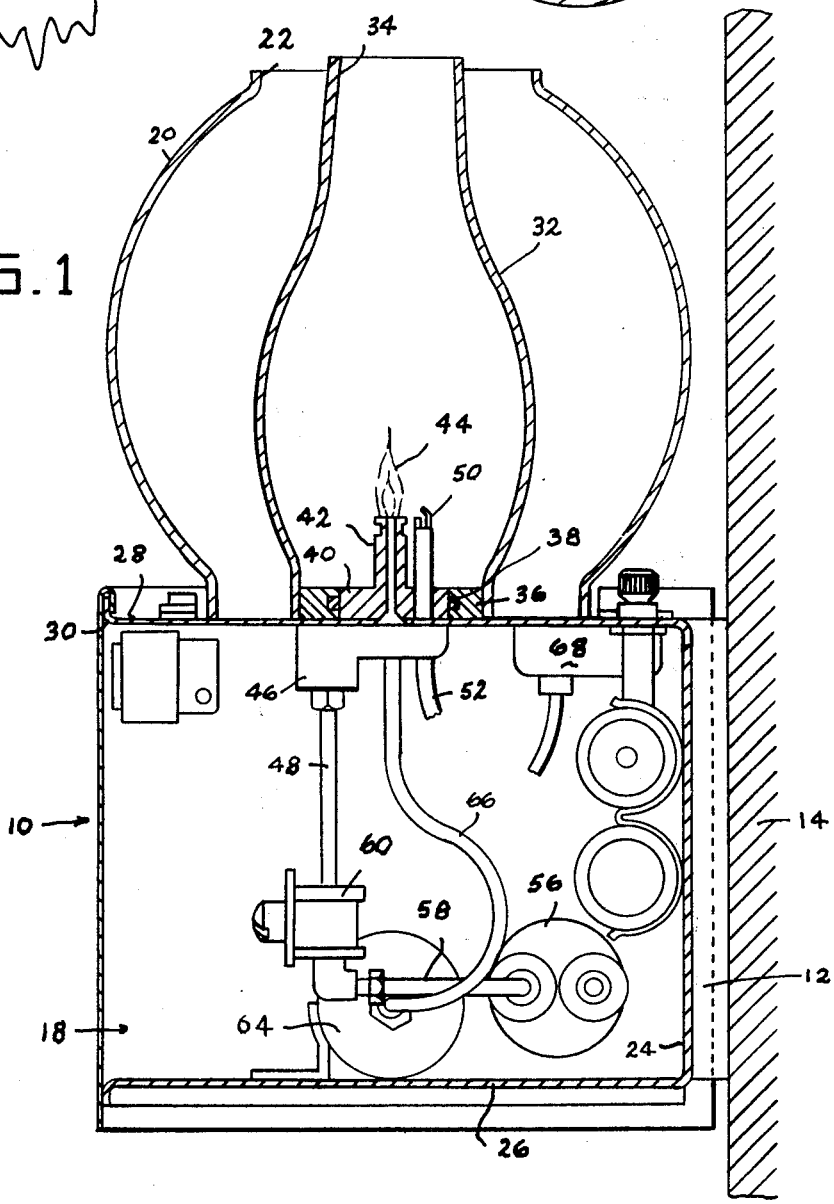

CONDITION DETECTOR, ESPECIALLY FOR DETECTING ATMOSPHERIC CONDITIONS

RELATED APPLICATIONS

Inventor: Stanley J. Kowalsky, Ser. No. 848,492; Filed: Aug. 8, 1969; Title: GAS, SMOKE AND FIRE ALARM SYSTEM (Now Abandoned).

Inventor: Stanley J. Kowalsky; Ser. No. 196,035; Filed: Nov. 5, 1971; Title: ALARM SYSTEM OPERATED BY AMBIENT CONDITIONS, now U.S. Pat. No. 3,896,422. Application Ser. No. 196,035 was a continuation in part of the above Ser. No. 848,492.

BACKGROUND OF THE INVENTION

This invention relates to a warning alarm device adapted to be mounted in homes, apartment buildings, factories, etc.. More particularly, the warning device is of the type which monitors the condition of the ambient air in order to detect the presence of combustion products indicative of fire, or the presence of gases, such as carbon monoxide.

An important object of the present invention resides in the efficient utilization of a flame detecting switch device such as disclosed in U.S. Pat. No. 3,407,369, issued Oct. 22, 1968, to W. J. Hardesty, as part of an early warning fire alarm system.

Another object is the provision of an extremely sensitive device for detecting oxygen deficiency in the atmosphere ambient to the device.

BRIEF SUMMARY OF THE INVENTION

In accordance with the present invention, the condition of air from one or more regions, such as rooms, is monitored for the presence of combustion products, such as gas, smoke and aerosols, and for the presence of any gas which reduces the supply of oxygen in the ambient atmosphere.

A burner flame is regulated to produce a continuous flame at the bottom of a vertically elongated chimney enclosure under normal ambient air conditions. The requisite supply of oxygen for maintaining the flame is drawn in at the top of the chimney and is thereby disturbed when gases other than oxygen, or air which is depleted in oxygen, enter the upper end of the chimney. At a certain oxygen deficiency in the combustion atmosphere supplied to the flame, the flame will be extinguished. Extinction of the flame is sensed by a flame detecting switch device to cause a signal, such as an alarm, to be actuated.

In one form of the invention, the detector having the flame is mounted in an enclosure placed in an elevated location in a multiple room building, for example, in the attic of a residence, and ducts lead from the enclosure to each room of the building. The detector in this manner becomes sensitive to an abnormal atmospheric condition in any room which is connected by a duct to the enclosure.

In some cases, the attic space, itself, may serve as the enclosure and the ducts would, in such a case, lead into the attic space rather than into a separate enclosure for the detector.

BRIEF DESCRIPTION OF THE DRAWINGS

The objects referred to above, and advantages of the invention, will become apparent upon reference to the following detailed specification, taken with the accompanying drawings, in which:

FIG. 1 is a schematic vertical sectional view of the detecting device of the present invention.

FIG. 2 is a perspective view showing a modification of the device.

FIG. 3 is a plan view of a modification of the device.

DETAILED DESCRIPTION OF THE INVENTION

Figure 4:
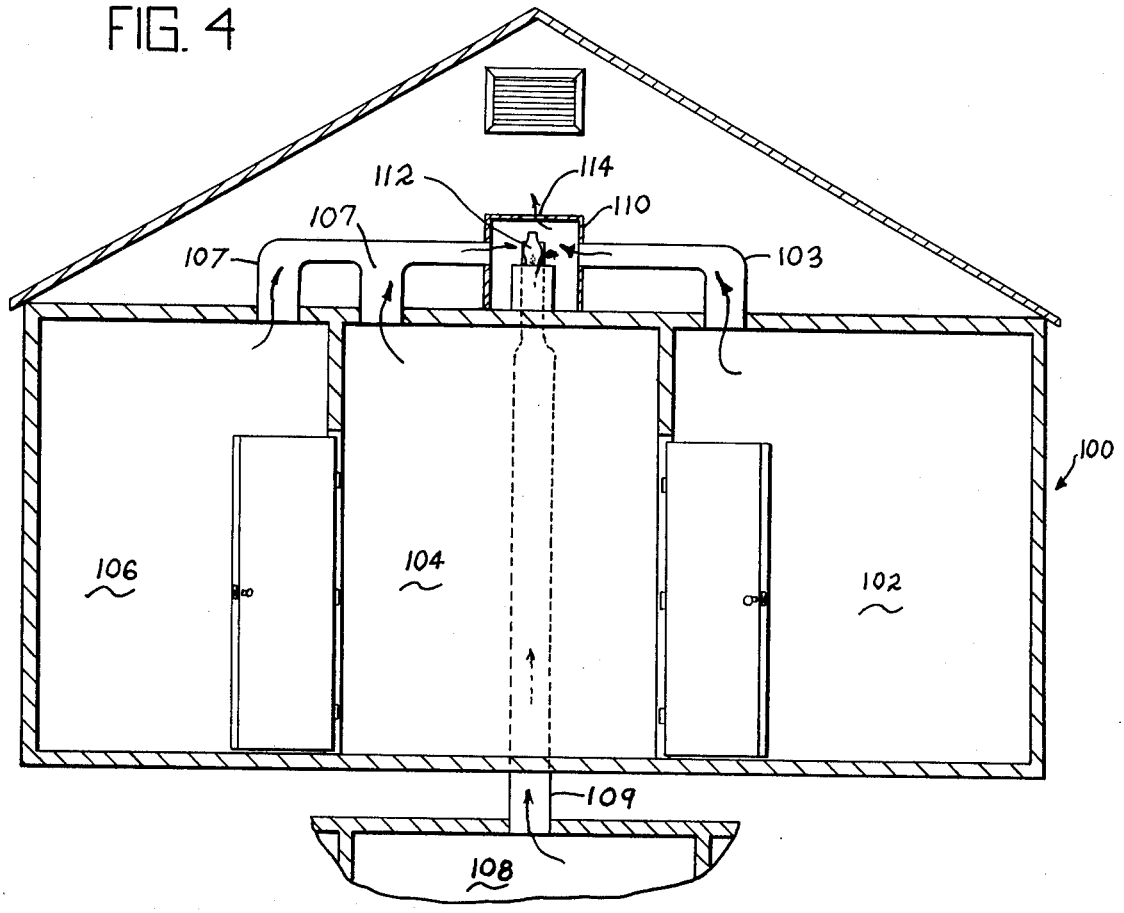
FIG. 4 shows how a single detector can be employed to monitor the air in each of several rooms.

Referring now to the drawings in detail, FIG. 1 illustrates the detecting device of the present invention generally referred to by reference numeral 10. As shown, the device includes a frame 12 which may be secured to a vertical support 14. The frame supports the various components of the device within a housing 18, and which supports a decorative cover 20 made of any suitable material and having an opening 22 at the top thereof through which ambient air conditions surrounding the device may be monitored as will be hereinafter explained. The upper end of the device may be disposed close to a ceiling and is, thus, extremely sensitive to changes in atmosphere in that vicinity. Since most unwanted gases, carbon dioxide, for example, are generated in the presence of heat, they can be best detected near the ceiling of an enclosure.

The frame 12 and housing 18 include a back wall 24 from which lower and upper supporting plates 26 and 28 extend. The front wall of housing 18 is suspended from the upstanding rim 30 on the upper supporting plate 28 so as to enclose the components of the device which are disposed between the lower and upper supporting plates.

The cover 20, which is mounted on the upper supporting plate 28, encloses a vertically elongated chimney stack 32 having an upper open end 34 projecting slightly above the cover 20 and a lower end resting on the plate 28 and sealed thereto by a sealing ring 36. The sealing ring is internally grooved to seat an O-ring 38 in sealing engagement with the base portion 40 of a burner having an upwardly projecting stem 42 from which a flame 44 extends when a gaseous fuel such as natural gas is supplied to the burner through the fitting 46 suspended below the plate 28. The flame 44 thus constitutes a pilot light which will be maintained continuously as long as a requisite supply of oxygen flows downwardly thereto inside the stack 32.

Should gases free of oxygen, or depleted in oxygen to a predetermined degree, enter the stack at its upper end 34, the supply of oxygen to the flame will be reduced or cut-off causing the flame to be extinguished. The flame is, accordingly, adjusted so as to be sensitive to a desired degree to such changes in ambient conditions. Thus, the ambient air is monitored for the presence of unwanted gases, such as combustion products.

The pilot flame 44 is maintained by a regulated supply of natural gas fuel to the fitting 46 through conduit 48. The pilot flame may be ignited by an electric type of igniting device 50 to which a source of electrical energy is connected through the cable 52. Any convenient of available source of energy may be utilized to produce the pilot flame. Gaseous fuel is preferred for operating the flame burner and is supplied through a gas filter 56. The outlet of the gas filter is connected through a tube 58 to an adjustable gas flow regulator 60 from which the supply tube 48 extends upwardly to the fitting 46.

Mounted on the lower plate 26, is a flame detecting switch device 64 of the type disclosed in U.S. Pat. No.

3,407,369 aforementioned. Thus, the flame detecting switch device is connected by a heat conductor 66 to the flame burner device in order to sense the presence or absence of the flame 44. When the flame is extinguished, the flame detecting switch device 64 triggers, or activates, a signal such as an electrically operated alarm, the components of which may be mounted in the frame.

For example, the upper mounting plate 28 may mount an audible alerting device such as a buzzer 68 which is electrically operated by electric current from either an a.c. source or a d.c. source. In the embodiment illustrated, the warning device is normally energized from the usually available a.c. power supply and may be turned off through an on-off switch mounted on the device. Should the a.c. power supply fail, the warning device may still be operative from a d.c. power supply.

The sensitivity of the device can be regulated by controlling the effective size of the smaller upper end 34 of chimney 32. To this end, FIG. 2 shows a cup 80 adapted to be placed on the upper end of the chimney and having a hole 82 therein smaller than upper end 34 of the chimney. By selecting a size for hole 82, the device can be adapted to different conditions of ambient air and can be made as sensitive as desired.

In FIG. 3, a cup 84 is shown having blades 86 and 88 pivoted thereon 90 and 92. Center hole 94 of cup 84 can be varied as to effective size by adjustment of the blades 86 and 88 about pivots 90, 92, whereby the device can be brought to the desired degree of sensitivity.

The chimney 32 is important and is about 4 to 5 times as high as the diameter of the smaller upper end thereof. The cooler combustion air will enter upper end 34 of the chimney at the periphery thereof while the products of combustion from the flame will rise out of the chimney near the center thereof.

The use of vertically elongated chimney ,i.e., a chimney which has a height several times the smallest diameter thereof and which chimney is sealed at the lower end to the base of the burner, is believed to be a novel and important contribution in the art, and makes a device of the general type described useful for the home and office for the first time because of the extreme sensitivity of the device.

It is believed that the counterflow conditions established for the combustion air flowing downwardly through the smaller upper end of the chimney to the flame and the products of combustion flowing upwardly away from the flame through the smaller upper end of the chimney, is what imparts the described high degrees of sensitivity to the device.

It will be appreciate that the important novel principle embodied in the device is maintaining the flame by combustion air drawn in through the top of the vertically elongated chimney stack and there is no other supply of oxygen to the flame. Thus, and especially when the device is placed in an uppr portion of an enclosure or room, a high degree of sensitivity exists and even small changes in ambient conditions will cause the flame to be extinguished.

FIG. 4 shows, diagrammatically, a building 100, which may be a residence building and having rooms 102, 104 and 106 and a basement or garage space 108. Ducts 103, 105, 107 and 109 connect the respective rooms with an attic mounted enclosure 110 in which a detector 112 according to the present invention is mounted. Vent 114 is provided for the enclosure 110 while the combustion air for the detector is supplied via the aforementioned ducts. The detector, as shown in FIG. 4, is sensitive to an abnormal condition in any room and can, thus, monitor the atmosphere throughout the building.

It will be evident that the enclosure for the detector may be the attic space itself. In such a case, the detector is preferably mounted near the ceiling of the attic space for maximum sensitivity.

In any of the events described above, it will be understood that the flame detector could be so disposed as to be actuated in response to substantial diminution of the flame as well as to extinguishing of the flame.

It will be apparent that the alarm or signally device operated by the detector could be spring operated and be triggered into signalling condition by flame failure or diminution. Such triggering arrangements are conventional on gas hot water tanks, and the like, which include a magnetically operated trigger element which is released upon failure of a pilot flame. With such an arrangement, no electric power for the detector or signal device is required.

Modifications may be made within the scope of the appended claims.

What is claimed is:

1. In a device for monitoring atmospheric conditions and operable for detecting oxygen deficiency therein; an imperforate horizontal base, a burner on the base and means to supply fuel to the burner which will burn in air and develop a flame, temperature sensitive means on the base adjacent the burner and actuated in response to diminution of the burner flame, an imperforate vertically elongate chimney open at the ends and having a height which is about four or five times the smallest diameter thereof and sealingly mounted on said base in surrounding relation to said burner and temperature sensitive means, combustion air for the burner flowing downwardly in the chimney from the upper end to the lower end while the gaseous products of combustion from said flame flow upwardly in the chimney from the lower end to the upper end in counter-flow to the combustion air, an enclosure in which said device is mounted, and ducts opening at one end into the enclosure and at the other end into respective regions of a building such as a residence building.

2. A device according to claim 1 in which said chimney is smaller in diameter at the upper end than it is at the lower end.

3. A device according to claim 1 which includes means receivable by the chimney near the upper end thereof for adjusting the effective diameter of the upper end of the chimney.

4. A device according to claim 2 which includes means receivable by the chimney near the upper end thereof for adjusting the effective diameter of the upper end of the chimney.

5. A device according to claim 1 which includes a member detachably mounted on the upper end of said chimney and having an aperture therein smaller in diameter than the upper end of the chimney for adjustment of the effective area of the upper end of the chimney for the passage of combustion air to the burner and the gaseous products of combustion from the burner.

6. A device according to claim 1 which includes a cup receivable out the upper end of the chimney and having a central aperture in the bottom wall, and mask elements movably mounted on the cup member and adjustable thereon for variably restricting said aperture thereby to control the effective area for the passage of combustion air to the burner and the gaseous products of combustion from the burner.

7. A device according to claim 1 in which said building has separate rooms and respective regions of said building comprise the separate rooms of the building.

8. A device according to claim 7 in which said enclosure is mounted above said rooms and the said ducts lead from upper levels of the respective rooms into said enclosure.

9. A device according to claim 7 in which said building has an attic and said enclosure is mounted in the attic and the said ducts lead from upper levels of the respective rooms upwardly into the said attic of the building and into said enclosure.

10. A device according to claim 9 in which said enclosure includes a vent located over the top of the chimney of the device.

11. A device according to claim 7 in which said enclosure is an attic space in the building above the said rooms of the building.

12. A device according to claim 10 in which said device is mounted near the highest part of the attic space.

* * * * *